US012635775B1

(12) United States Patent
Chen

(10) Patent No.: US 12,635,775 B1
(45) Date of Patent: May 26, 2026

(54) INTEGRATED CONDUCTING RING AND HAIR STYLING APPLIANCE

(71) Applicant: Dongguan Future Beauty Technology Co., Ltd, Dongguan City (CN)

(72) Inventor: Qing Chen, Yichun (CN)

(73) Assignee: Dongguan Future Beauty Technology Co., Ltd, Dongguan (CN)

( * ) Notice: Subject to any disclaimer, the term of this patent is extended or adjusted under 35 U.S.C. 154(b) by 0 days.

(21) Appl. No.: 19/232,662

(22) Filed: Jun. 9, 2025

(51) Int. Cl.
*A45D 2/36* (2006.01)
*A45D 1/04* (2006.01)

(52) U.S. Cl.
CPC ..... *A45D 1/04* (2013.01); *A45D 2/367* (2013.01)

(58) Field of Classification Search
CPC ..... H01R 35/04; H01R 39/64; A45D 1/04; A45D 2/367
See application file for complete search history.

(56) References Cited

U.S. PATENT DOCUMENTS 3,860,312 A * 1/1975 Gordon, Jr. ..... H01R 39/64 439/31
4,473,086 A * 9/1984 Thaler ..... A45D 1/18 132/229
4,492,241 A * 1/1985 Thaler ..... A45D 1/04 132/229
4,851,641 A * 7/1989 Barowski ..... A45D 1/04 132/229
5,074,796 A * 12/1991 Carter ..... H01R 13/642 439/21
6,009,884 A * 1/2000 Suh ..... A45D 2/48 132/217
6,561,813 B2 * 5/2003 Rutten ..... H01R 39/08 439/26
7,082,949 B2 * 8/2006 Julemont ..... A45D 1/12 132/266
7,322,858 B1 * 1/2008 Rogers ..... H01R 24/58 439/669
8,025,506 B2 * 9/2011 Cairns ..... H01R 39/08 439/24
8,292,645 B2 * 10/2012 Cairns ..... H01R 13/523 439/271
8,789,539 B2 * 7/2014 Linglin ..... A45D 1/04 132/224

(Continued)

*Primary Examiner* — Thanh Tam T Le
(74) *Attorney, Agent, or Firm* — Justin Lampel

(57) ABSTRACT

An integrated conducting ring and a hair styling appliance are provided. The integrated conducting ring includes a housing, a rotating member, and a wiring assembly. The housing is provided with a middle through hole and multiple mounting holes. The rotating member can be rotatably mounted in the middle through hole, and is provided with multiple annular electrodes and multiple lead wires. The multiple annular electrodes correspond to the multiple mounting holes; and the multiple lead wires are correspondingly connected to the multiple annular electrodes and extend out from a first end of the rotating member. The first end of the rotating member is connected to a driven mechanism, and a second end of the rotating member is connected to a drive mechanism. The wiring assembly includes multiple conducting members, and each conducting member is correspondingly mounted in one mounting hole and abuts against the corresponding annular electrode.

7 Claims, 12 Drawing Sheets

(56) References Cited

U.S. PATENT DOCUMENTS

| | | | | |
|---|---|---|---|---|
| 8,899,991 | B2 * | 12/2014 | Ickler | H01R 24/40 439/11 |
| 8,900,000 | B2 * | 12/2014 | Cairns | H01R 39/64 439/138 |
| 8,945,451 | B2 * | 2/2015 | Ries | B29C 45/1671 264/254 |
| 8,986,017 | B2 * | 3/2015 | Borg | H01R 39/64 439/13 |
| 9,039,423 | B2 * | 5/2015 | Shinder-Lerner | H01R 39/64 439/13 |
| 9,124,048 | B2 * | 9/2015 | Golko | H01R 43/20 |
| 10,624,435 | B2 * | 4/2020 | Yu | A45D 2/145 |
| 10,897,973 | B2 * | 1/2021 | Lee | A45D 1/04 |
| 11,058,199 | B2 * | 7/2021 | Chelle | A45D 1/16 |

* cited by examiner

INTEGRATED CONDUCTING RING AND HAIR STYLING APPLIANCE

TECHNICAL FIELD

The present disclosure relates to the field of hair styling appliances, and in particular to an integrated conducting ring and a hair styling appliance.

BACKGROUND

With the development of the living standard of people, requirements of the people for hairstyles are also increasing. Therefore, various automatic hair curlers have emerged in the market to meet needs of different users. For the convenience of users, there is a hair styling appliance appeared in the market. Generally, a conducting ring is disposed between a heating rod and a handle, and the transmission and electrification between the heating rod and the handle are achieved through the conducting ring. At present, the conducting ring in the hair styling appliance is generally composed of a rotating seat rotatably installed in the handle and a conducting clip arranged on a circuit board in the handle. The rotating seat is provided with an annular electrode, and the conducting clip is elastically clamped outside the annular electrode to achieve conduction. However, when this conducting ring structure is used, foreign matters such as dust are easy to enter between the annular electrode and the conducting clip, which is prone to causing poor contact between the annular electrode and the conducting clip, making use reliability poor, and affecting the user experience.

SUMMARY

A main objective of the present disclosure is to provide an integrated conducting ring, aiming at improving reliability of the conducting ring.

To achieve the objective above, the present disclosure provides an integrated conducting ring, including

- a housing, provided with a middle through hole and multiple mounting holes, where the multiple mounting holes are spaced apart in an axial direction of the middle through hole, and run through an inner wall of the middle through hole;
- a rotating member, rotatably mounted in the middle through hole and provided with multiple annular electrodes and multiple lead wires, where the multiple annular electrodes are spaced apart in the axial direction of the middle through hole and correspond to the multiple mounting holes one by one, the multiple lead wires are correspondingly connected to the multiple annular electrodes one by one and extend out from a first end of the rotating member, the first end of the rotating member is used for connecting to a driven mechanism, a second end of the rotating member is used for connecting to a drive mechanism; and
- a wiring assembly, including multiple conducting members, where each conducting member is correspondingly mounted in one mounting hole and abuts against the corresponding annular electrode.

The present disclosure further provides a hair styling appliance, including handle, a styling accessory, and an integrated conducting ring. The integrated conducting ring includes a housing, a rotating member and a wiring assembly. The housing is provided with a middle through hole and multiple mounting holes; the multiple mounting holes are spaced apart in an axial direction of the middle through hole, and run through an inner wall of the middle through hole. The rotating member is rotatably mounted in the middle through hole and provided with multiple annular electrodes and multiple lead wires, the multiple annular electrodes are spaced apart in the axial direction of the middle through hole and correspond to the multiple mounting holes one by one, and the multiple lead wires are correspondingly connected to the multiple annular electrodes one by one and extend out from a first end of the rotating member. The wiring assembly includes multiple conducting members, and each conducting member is correspondingly mounted in one mounting hole and abuts against the corresponding annular. A drive mechanism is arranged in the handle, the styling accessory is rotatably mounted at one end of the handle, the housing is fastened to the handle, a first end is connected to the styling accessory, and a lead wire extending out from the first end is electrically connected to an electrical appliance on the styling accessory, a second end of the rotating member is connected to the drive mechanism, and the wiring assembly on the integrated conducting ring is electrically connected to a circuit board in the handle.

Through the technical solution in the present disclosure, a rotating member is mounted in a housing, and the housing is provided with a mounting hole for mounting a conducting member of a wiring assembly, so that the annular electrode on the rotating member and the conducting member are both located in the housing. During use, the annular electrode and the conducting member can be effectively protected, a risk that dust, welding slag and other foreign matters enter between the annular electrode and the conducting member is reduced, the contact reliability between the annular electrode and the conducting member is improved, thereby improving us reliability of the integrated conducting ring. Moreover, as an independent component, the integrated conducting ring can improve fitting accuracy between the rotating member and the housing as well as between the annular electrode and the conducting member, so that the rotating member has high accuracy when rotating, the concentric stability is improved and the jitter is reduced. In addition, it is convenient for the assembly of the hair styling appliance and the replacement of the conducting ring. As an independent component, the integrated conducting ring can adapt to various mounting environments.

BRIEF DESCRIPTION OF THE DRAWINGS

To describe the technical solutions of the present disclosure or in the prior art more clearly, the following briefly introduces the accompanying drawings required for describing the embodiments or the prior art. Apparently, the accompanying drawings in the following description show merely some embodiments of the present disclosure, and those of ordinary skill in the art may still derive other drawings from these accompanying drawings without creative efforts.

In the drawings.

Figure 1:
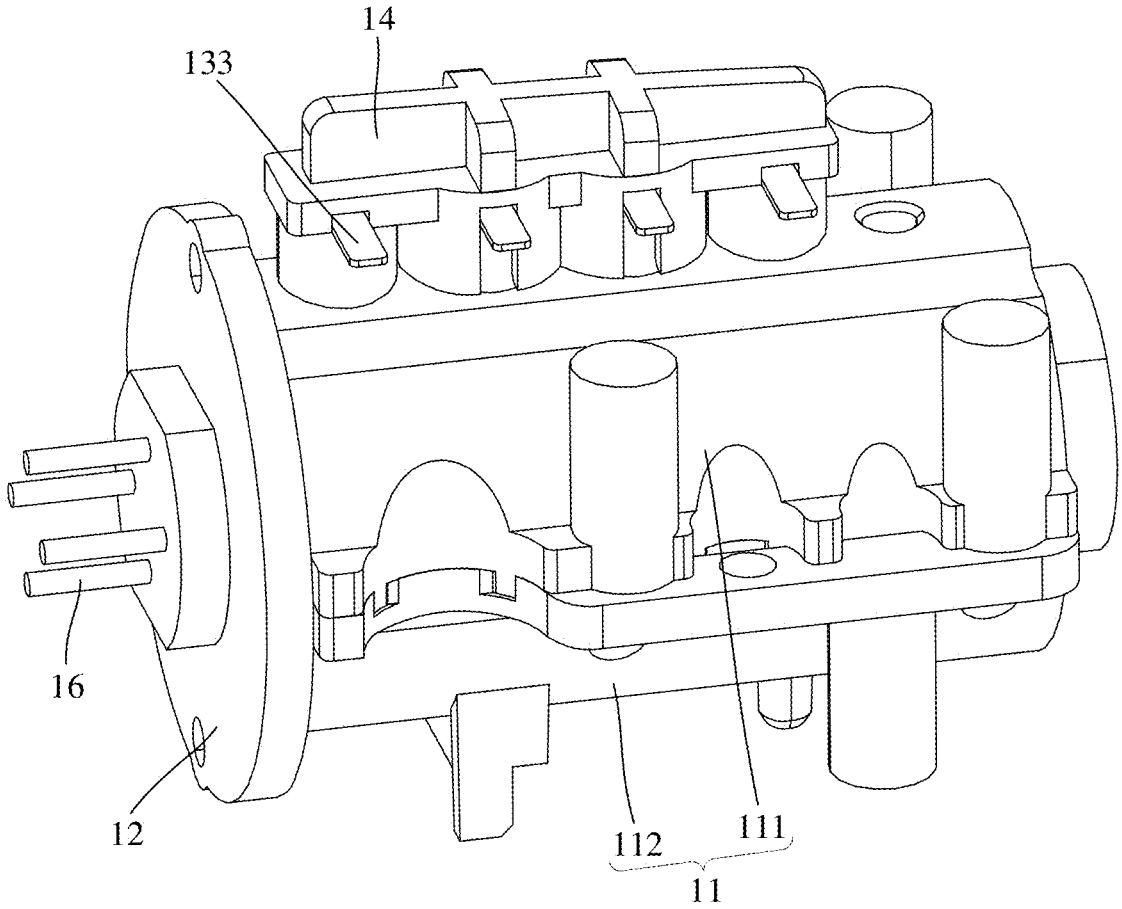
FIG. 1 is a structural diagram of an embodiment of an integrated conducting ring according to the present disclosure.
Figure 2:
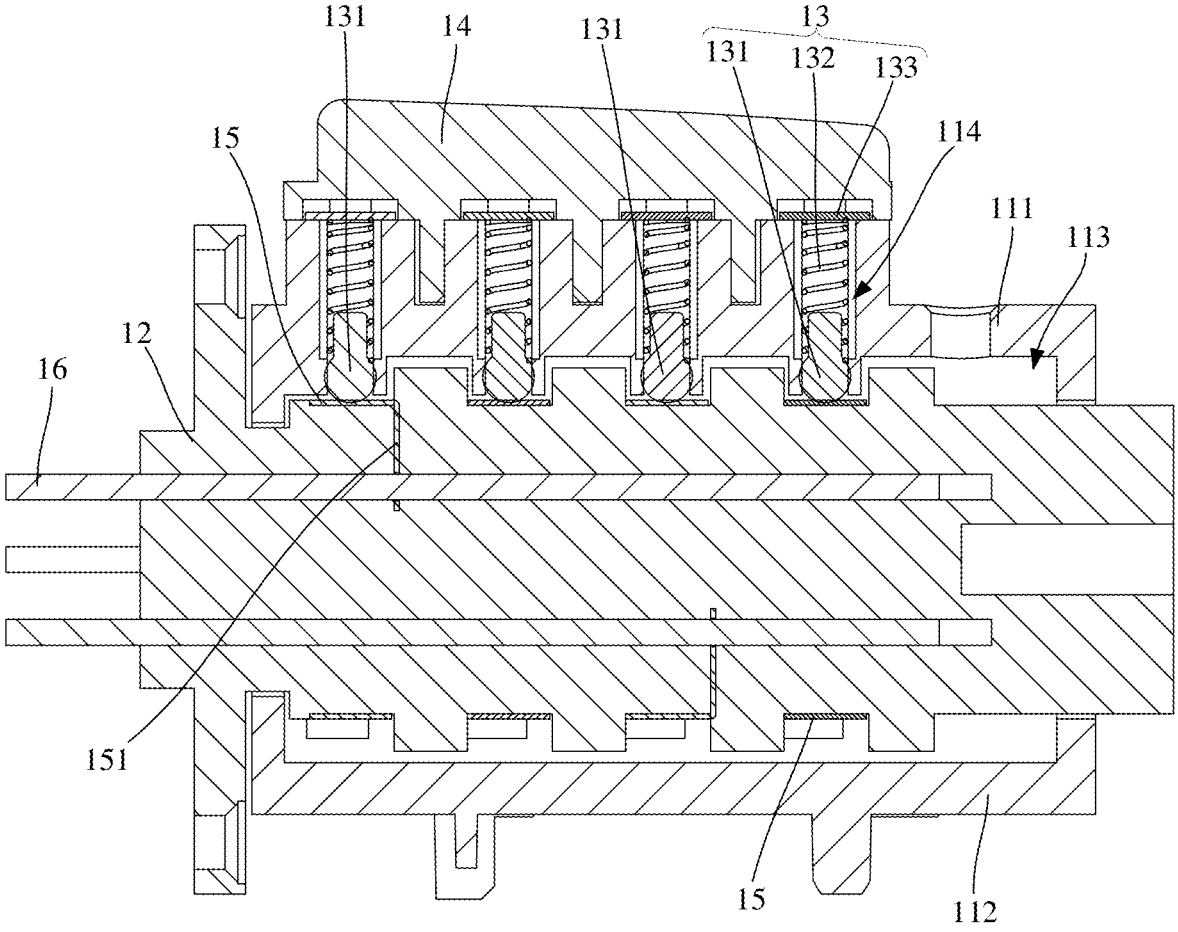
FIG. 2 is a sectional view of an integrated conducting ring in FIG. 1.
Figure 3:
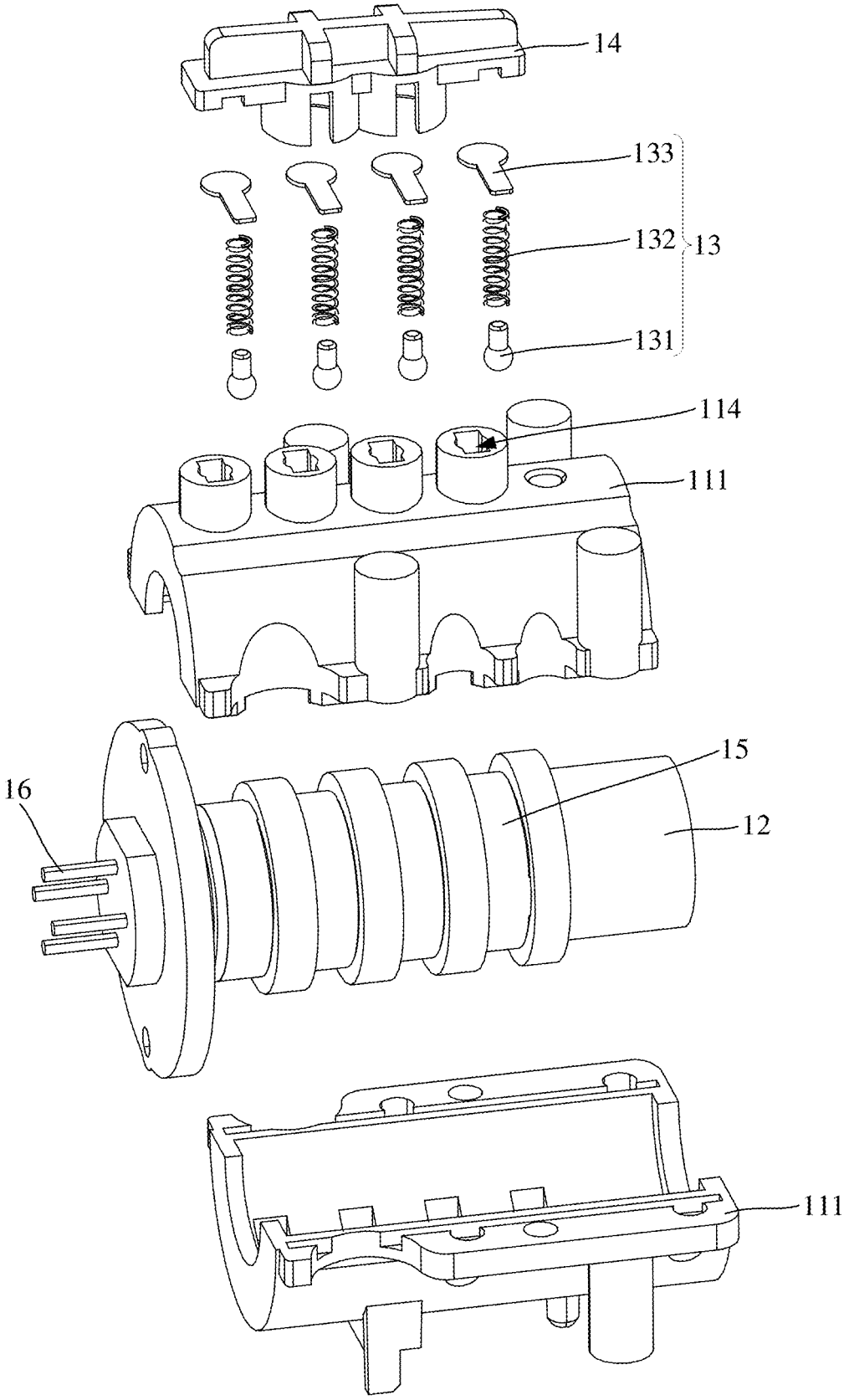
FIG. 3 is an exploded view of an integrated conducting ring in FIG. 2.
Figure 4:
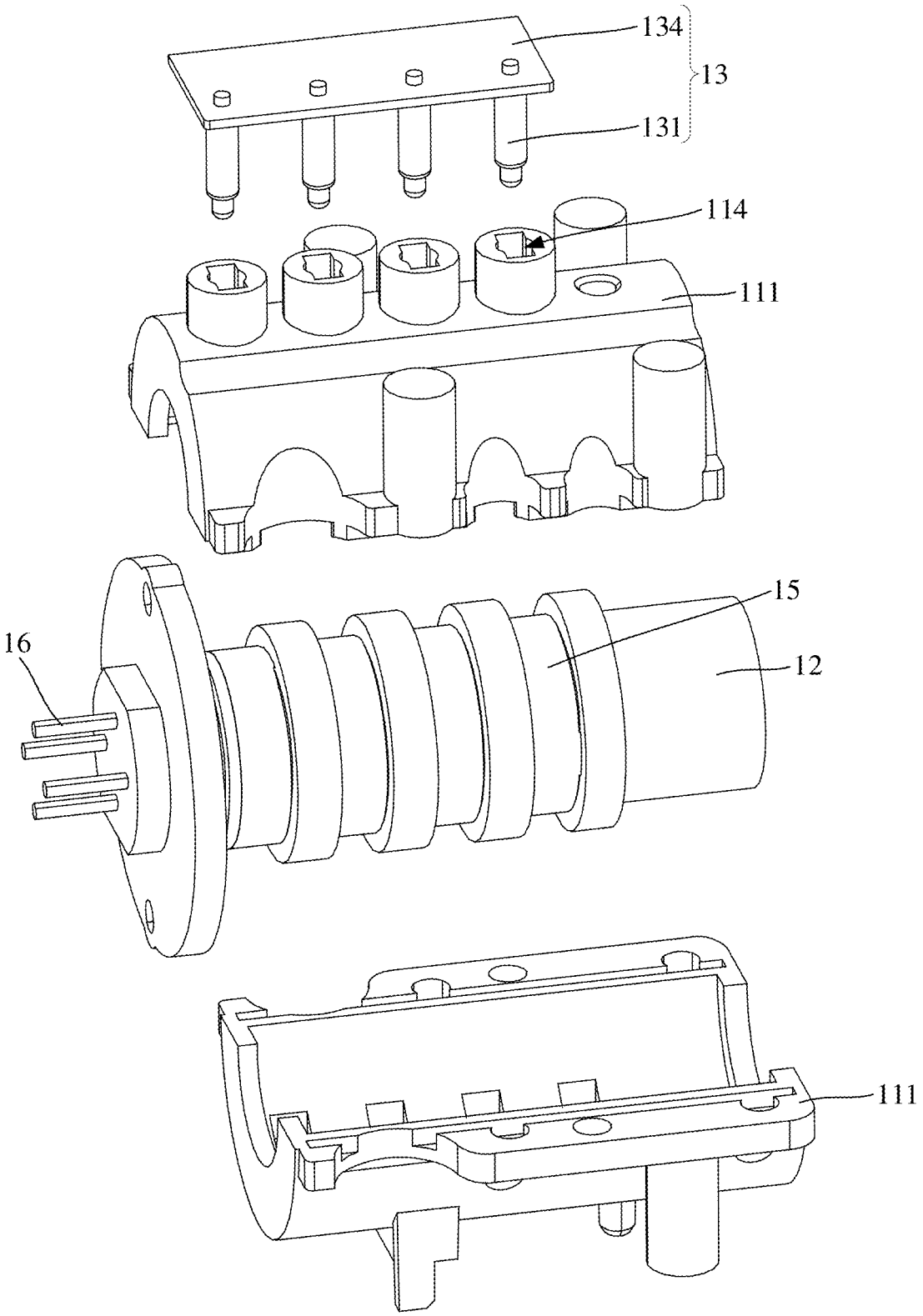
FIG. 4 is an exploded view of another embodiment of an integrated conducting ring according to the present disclosure.

10—integrated conducting ring; 11—housing; 111—first housing; 112—second housing; 113—middle through hole; 114—mounting hole; 12—rotating member; 13—wiring assembly; 131—conductor; 132—elastic member; 133—stopper; 134—circuit board; 14—lead wire cover, 15—annular electrode; 151—connecting portion; 16—lead wire; 21—handle; 211—drive mechanism; 212—circuit board; 22—curling rod; 213—first air duct; 214—fan assembly; 215—vent port; 216—air inlet; 217—first conducting terminal; 30—styling accessory; 301—second air duct; 302—air outlet; 31—comb tooth; 32—connecting shaft; 331—heating assembly; 332—phototherapy lamp; 34—sleeve portion; 35—air guide portion; 351—third air duct; 352—blowout port; 353—cylindrical portion; 354—light-transmitting portion; 36—second conducting terminal.

The implementation, functional characteristics and advantages of the objective of the present disclosure are further described with reference to the accompanying drawings in conjunction with embodiments.

DETAILED DESCRIPTION OF THE EMBODIMENTS

The following clearly and completely describes the technical solutions in embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the scope of protection of the present disclosure.

Furthermore, if there are descriptions relating to "first" and "second" in the embodiments of the present disclosure, the terms "first" and "second" are used for descriptive purposes only and are not to be construed as indicating or implying relative importance or implying the number of the indicated technical features. In this way, the feature defined by "first" and "second" can explicitly or implicitly include one or more features. In addition, technical solutions in various embodiments may be combined with each other, provided that they can be implemented by those of ordinary skill in the art. When a combination of the technical solutions incurs conflict or cannot be implemented, it should be considered that such a combination of the technical solutions does not exist, and does not fall within the claimed scope of protection of the present disclosure either.

The present disclosure provides an integrated conducting ring, which is used in a hair styling appliance and other electrical appliances that require transmission and conduction.

In an embodiment of the present disclosure, as shown in FIG. 1 to FIG. 6, the integrated conducting ring 10 includes a housing 11, a rotating member 12, and a wiring assembly 13. The housing 11 is provided with a middle through hole 113 and multiple mounting holes 114. The multiple mounting holes 114 are spaced apart in an axial direction of the middle through hole 113, and run through an inner wall of the middle through hole 113. The rotating member 12 may be rotatably mounted in the middle through hole 113 and provided with multiple annular electrodes 15 and multiple lead wires 16. The multiple annular electrodes 15 are spaced apart in the axial direction of the middle through hole 113 and correspond to multiple mounting holes 114 one by one. The multiple lead wires 16 are correspondingly connected to the multiple annular electrodes 15 one by one and extend out from a first end of the rotating member 12. The wiring assembly 13 includes multiple conducting members 131, each conducting member 131 is correspondingly mounted in one mounting hole 114 and abuts against the corresponding annular electrode 15.

Specifically, the first end of the rotating member 12 is a power output end and is used for connecting to a driven mechanism, and a second end of the rotating member 12 is a power input end and is used for connecting to the drive mechanism 211. The annular electrode 15 is sleeved on the rotating member 12, the multiple annular electrodes 15 are spaced apart in an axial direction of the rotating member 12. When the rotating member 12 rotates in the middle through hole 113, the conducting member 131 always abuts against a peripheral surface of the annular electrode 15. When the integrated conducting ring 10 is mounted on the hair styling appliance, the housing 11 is fastened into a handle 21 of the hair styling appliance, the first end of the rotating member 12 is connected to a curling rod 22 of the hair styling appliance, the second end of the rotating member 12 is connected to the drive mechanism 211 in the handle 21, so that the drive mechanism 211 can drive the curling rod 22 to rotate through the rotating member 12. A lead wire 16 extending out from the first end is electrically connected to a heating assembly on the curling rod 22, the wiring assembly 13 is electrically connected to a circuit board 212 in the handle 21, thereby electrically the heating assembly on the curling rod 22 to the circuit board 212 in the handle 21. The lead wire 16 may be a metal pin/post, a metal lead wire, or the like.

Through the technical solution in the present disclosure, the rotating member 12 is mounted in the housing 11, and the housing 11 is provided with a mounting hole 114 for mounting a conducting member 131 of the wiring assembly 13, so that the annular electrode 15 on the rotating member 12 and the conducting member 131 are both located in the housing 11. During use, the annular electrode 15 and the conducting member 131 can be effectively protected, a risk that dust, welding slag and other foreign matters enter between the annular electrode 15 and the conducting member 131 is reduced, and contact reliability between the annular electrode 15 and the conducting member 131 is improved, thereby improving use reliability of the integrated conducting ring 10. Moreover, as an independent component, the integrated conducting ring 10 can improve fitting accuracy between the rotating member 12 and the housing 11 as well as between the annular electrode 15 and the conducting member 131, so that the rotating member 12 has high accuracy when rotating, the concentric stability is improved, and the jitter is reduced. In addition, it is convenient for the assembly of the hair styling appliance and the replacement of the conducting ring. As an independent component, the integrated conducting ring can adapt to various mounting environment.

In some embodiments, the multiple mounting holes 114 are formed in a same side of the middle through hole 113. In this way, the multiple conducting members 131 can be mounted in an integrated manner, which is also conducive to reducing an occupied space of the integrated conducting ring 10.

In some embodiments, the housing 11 includes a first housing 111 and a second housing 112 which are assembled together to form the middle through hole 113, and the first housing 111 is provided with a plurality of mounting holes 114. Specifically, an assembly surface of the first housing 111 and the second housing 112 is approximately parallel to an axis of the middle through hole 113. Such an arrangement is convenient for mounting of the rotating member 12 and the conducting member 131.

In some embodiments, the wiring assembly 13 further includes an elastic member 132 and a stopper 133, the stopper 133 is located outside the mounting hole 114, the elastic member 132 is located in the mounting hole 114 and abuts between the conducting member 131 and the stopper 133. Specifically, the stopper 133 is fastened to the housing 11, the elastic member 132 is in a compressed state to make the conducting member 131 abut against the annular electrode 15, so that the conductor can always abut against the annular electrode 15 to further improve reliability of electrical connection between the annular electrode 15 and the conducting member 131.

In some embodiments, the elastic member 132 is a spring, in this way, the structure is simple and reliable, which makes the life of the elastic member 132 long and can prolong the service life of the integrated conducting ring 10. Certainly, in other embodiments, the elastic member 132 may be a rubber block.

In some embodiments, the clastic member 132 and the stopper 133 may both be a conductor, that is, the conducting member 131, the elastic member 132 and the stopper can achieve electric conduction when abutting in turn. When the integrated conducting ring 10 is used for the hair styling appliance, the lead wire can be directly connected from the stopper 133, so that wiring on the wiring assembly 13 can be reduced, and the structure of the integrated conducting ring 10 can be simplified. Optionally, the conducting member 131 is a conducting sphere, or the conducting member 131 is a carbon brush, or the conducting member 131 is a conducting post.

Optionally, the integrated conducting member 10 further includes a lead wire cover 14, where the lead wire cover is used to cover multiple stoppers 133, and is provided with a gap for a wiring terminal of the stopper 133 to extend out. In this way, multiple stoppers 133 can be fastened, and a risk of a short circuit between the stoppers 133 may also be reduced.

In some other embodiments, the conducting member 131 is a pogo pin. Specifically, the tip of the pogo pin abuts against a peripheral surface of the annular electrode 15. When the pogo pin is used as the conducting member 131, reliable conduction can be ensured, and assembly parts of the integrated conducting ring 10 can be reduced, which is convenient for assembly.

In some embodiments, the wiring assembly 13 further includes a circuit board 134, the multiple conducting members 131 are fastened to the circuit board 134. That is, during mounting, the circuit board 134 and the multiple conducting members 131 are mounted together to facilitate assembly and wiring on a production line.

In some embodiments, the annular electrode 15 is provided with a connecting portion 151 extending toward an inner side, the connecting portion 151 is connected to the lead wire 16, the annular electrode 15 and the lead wire 16 are used as inserts to undergo integrated injection molding with the rotating member 12. That is, the connecting portion 151 extends toward the inner side of the annular electrode 15, The annular electrode 15 and the lead wire 16 are used as inserts to undergo integrated injection molding with the rotating member 12, so that an assembly process can be reduced, and the annular electrode 15 and the lead wire 16 can be stably mounted, thereby reducing the risk of loosening of the annular electrode 15 and the lead wire 16. Certainly, in other embodiments, it is also possible to arrange multiple grooves extending in the axial direction on an outer side of the rotating member 12, and each lead wire 16 is correspondingly mounted in one groove.

Figure 5:
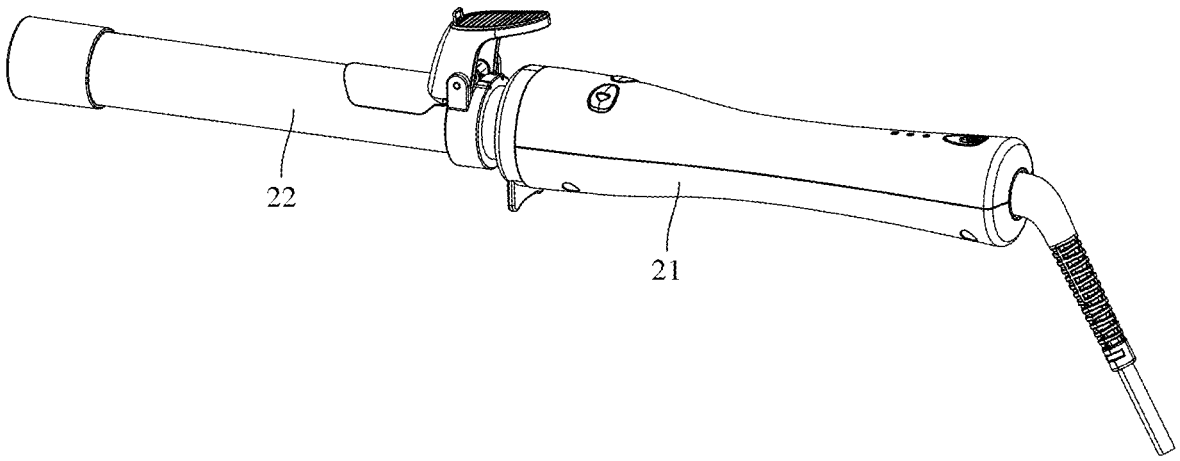
FIG. 5 is a structural diagram of an embodiment of a hair styling appliance according to the present disclosure.
Figure 6:
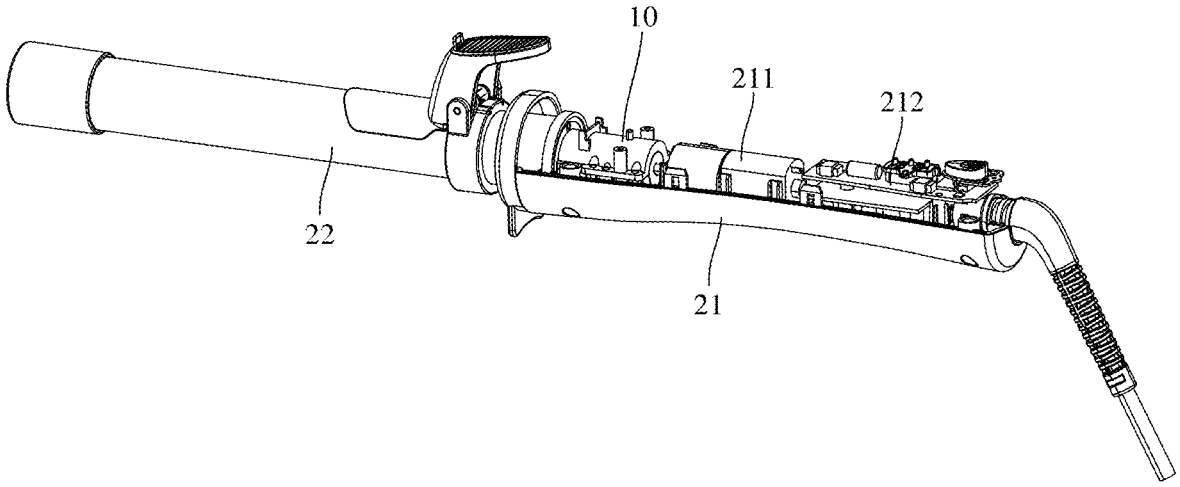
FIG. 6 is a structural diagram of a hair styling appliance in FIG. 5 after a part of structure is hidden.
Figure 7:
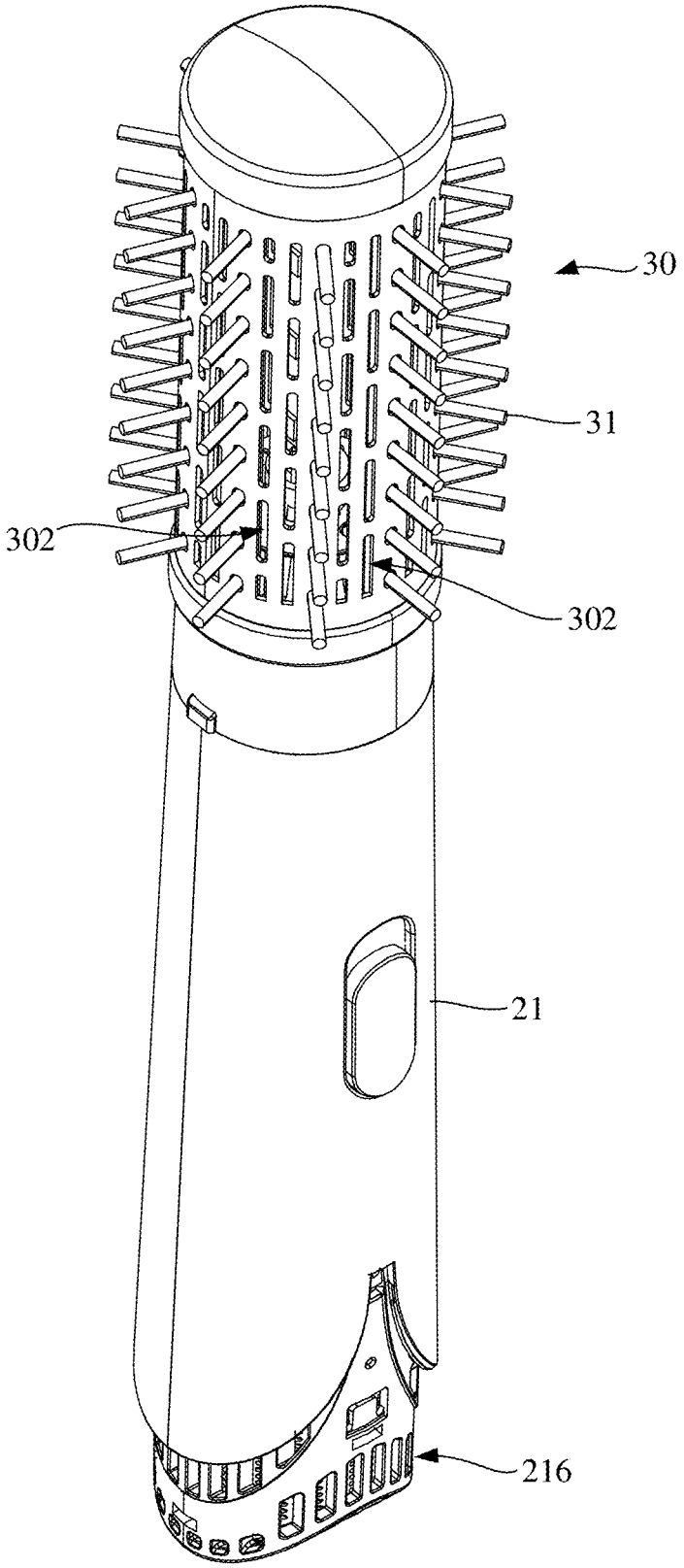
FIG. 7 is a structural diagram of another embodiment of a hair styling appliance according to the present disclosure.
Figure 8:
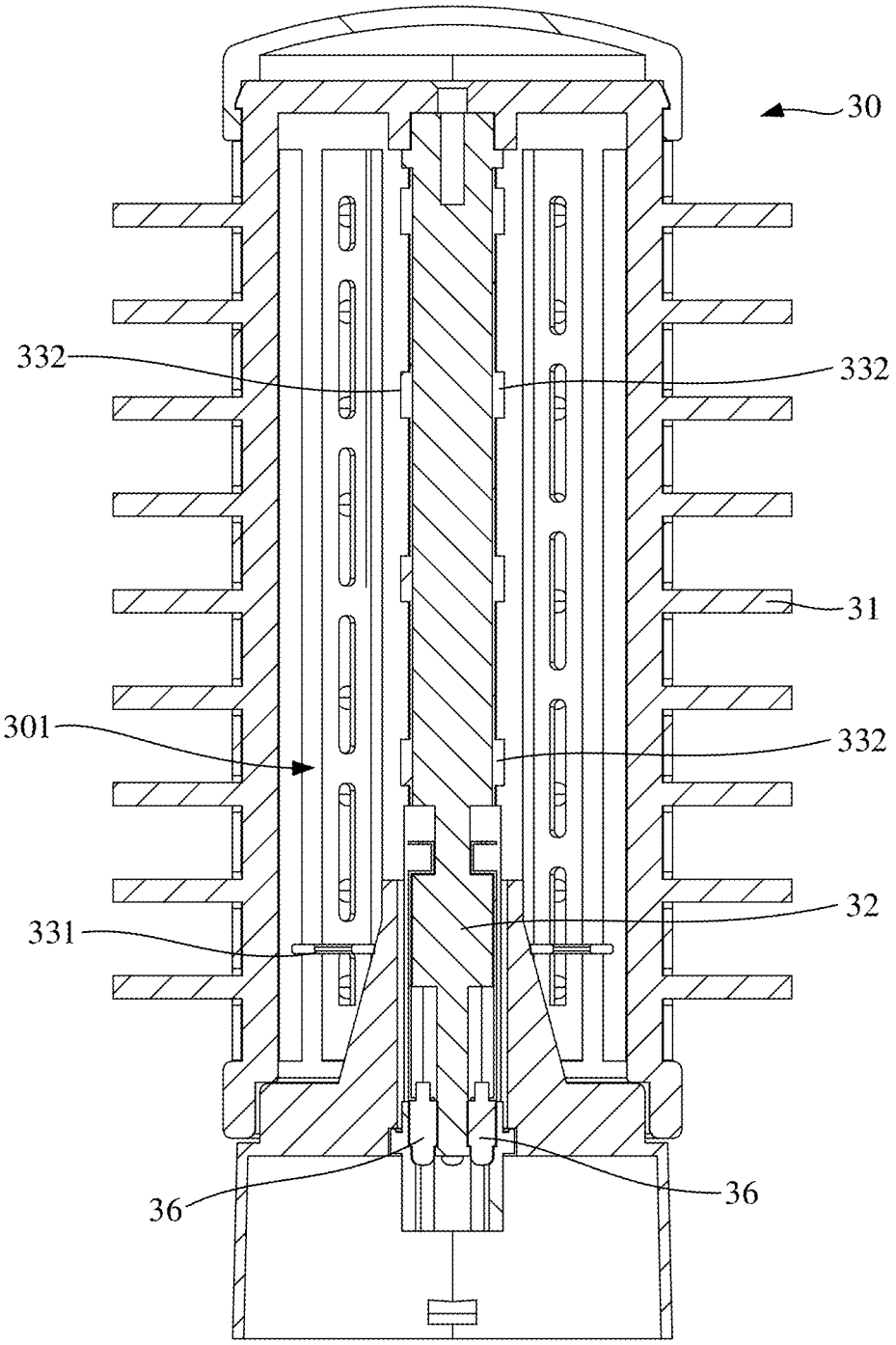
FIG. 8 is a sectional view of a styling accessory in FIG. 7.
Figure 9:
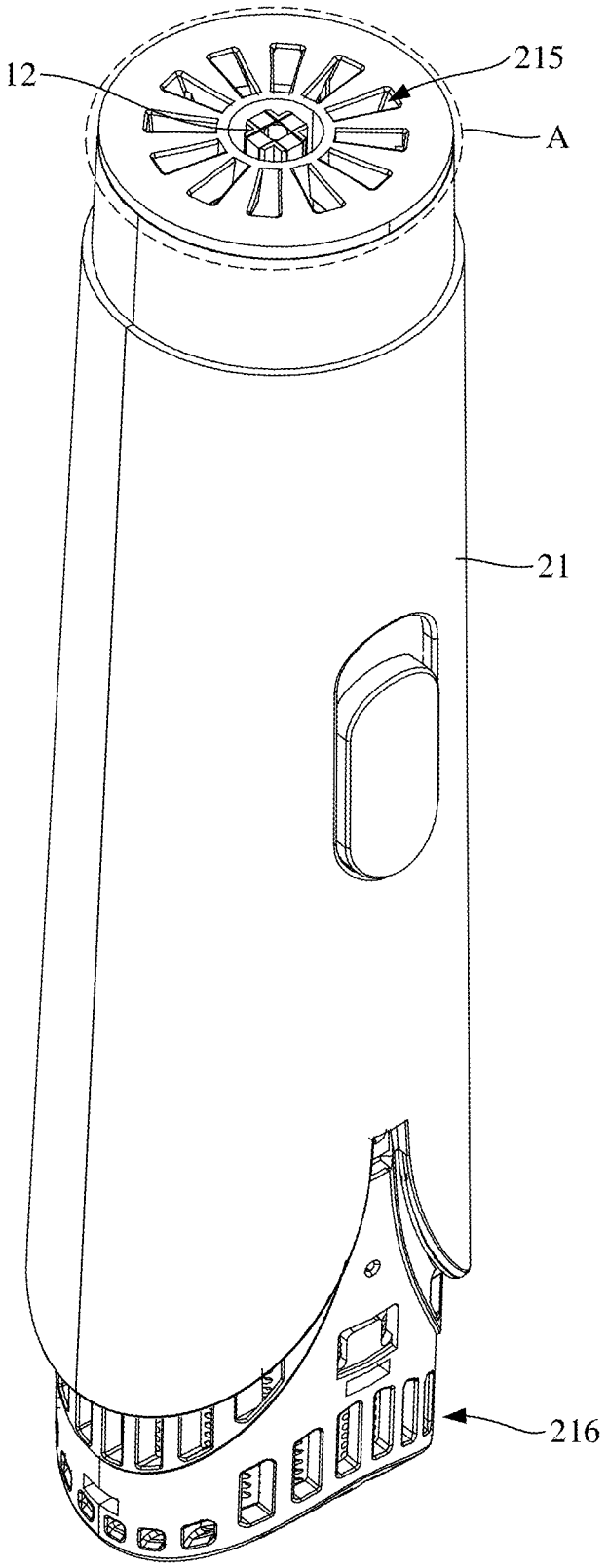
FIG. 9 is a structural diagram of a handle in FIG. 7.
Figure 10:
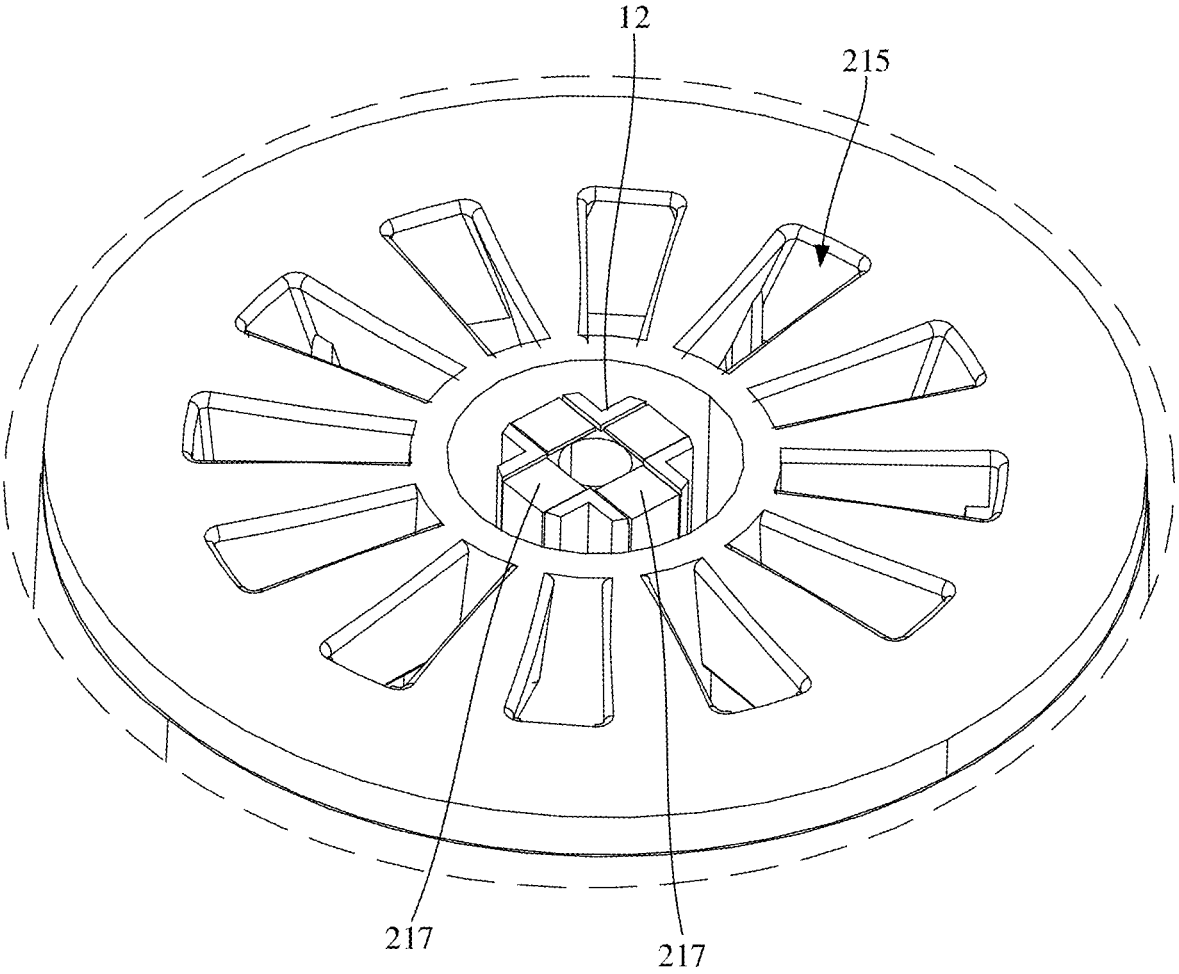
FIG. 10 is an enlarged view of position A in FIG. 9.
Figure 11:
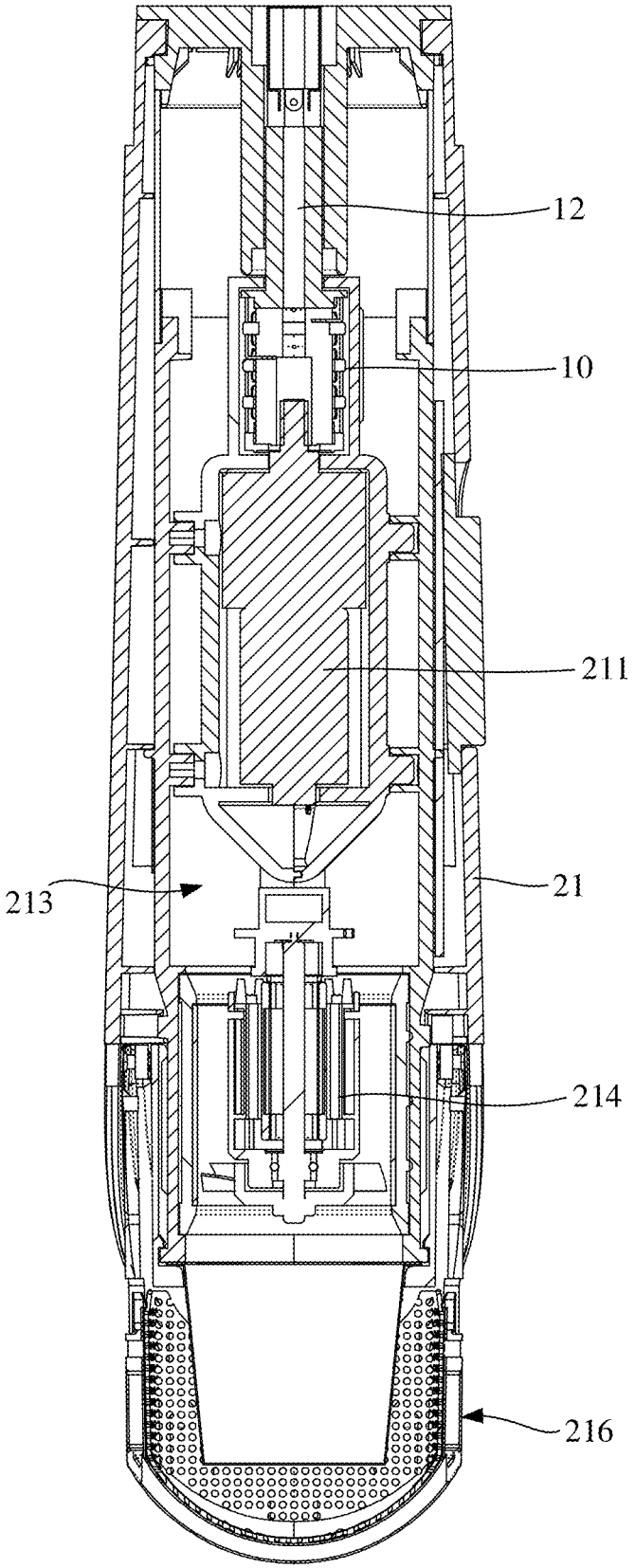
FIG. 11 is a sectional view of a handle in FIG. 9.
Figure 12:
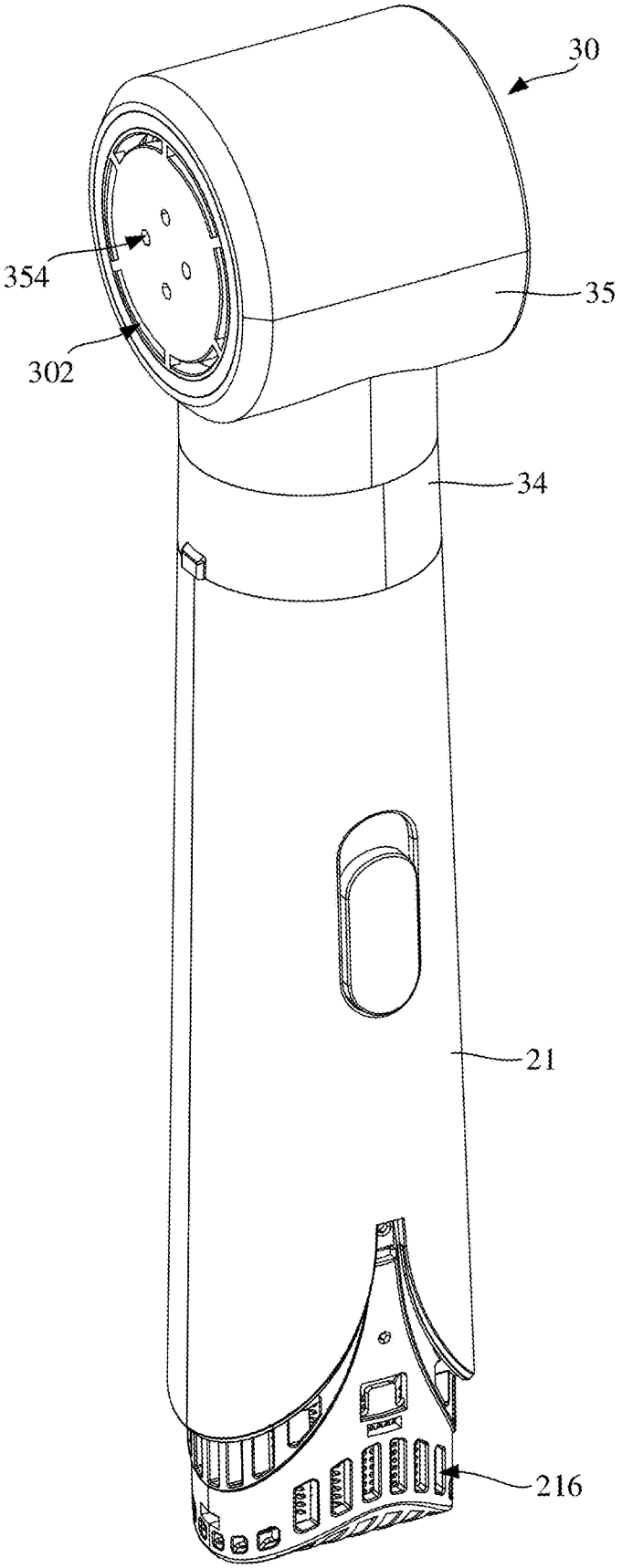
FIG. 12 is a structural diagram of yet another embodiment of a hair styling appliance according to the present disclosure.
Figure 13:
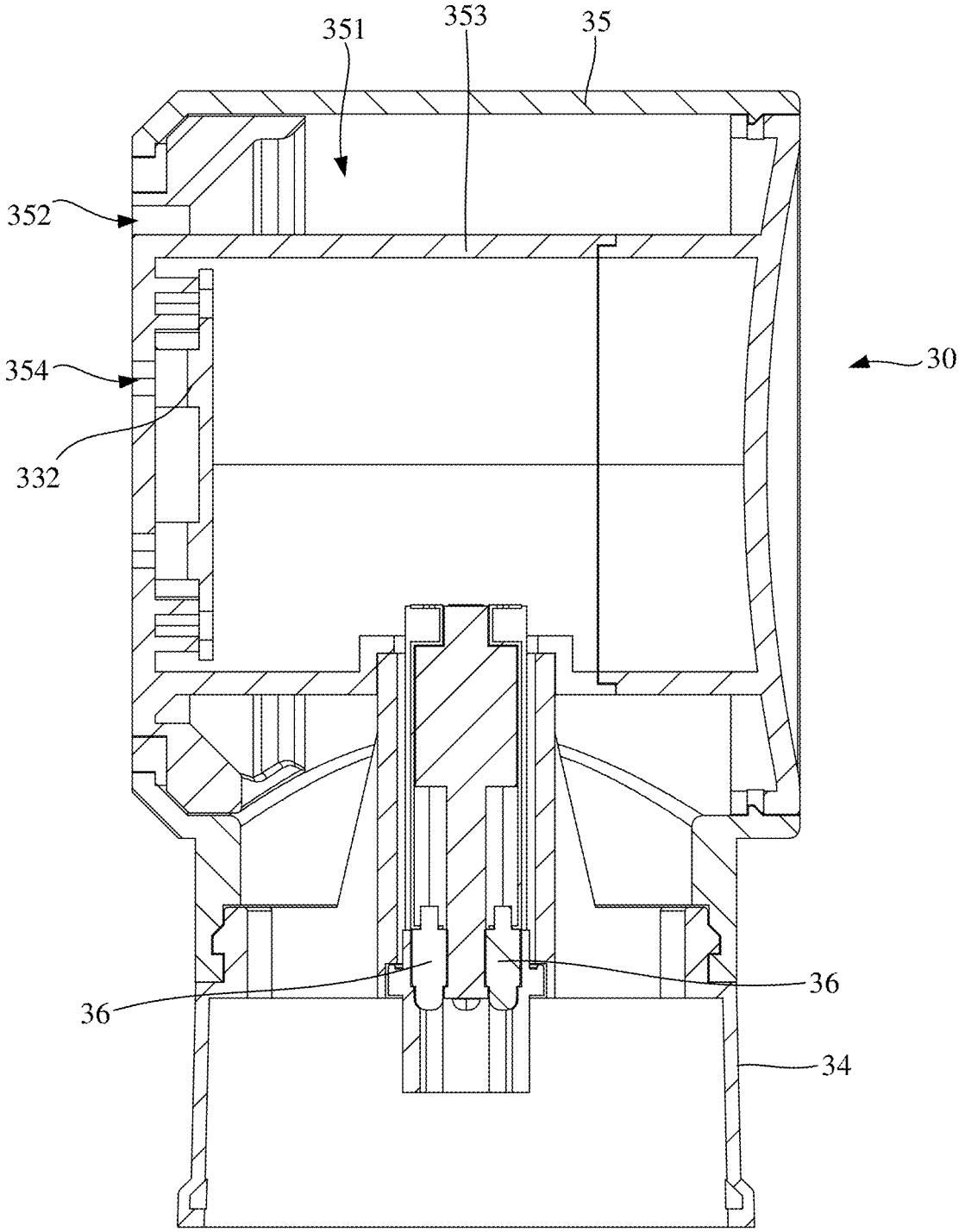
FIG. 13 is a sectional view of a styling accessory in FIG. 12.

The present disclosure further provides a hair styling appliance. As shown in FIG. 5 to FIG. 6, the hair styling appliance includes a handle 21, a curling rod 22, and an integrated conducting ring 10. A specific structure of the integrated conducting ring 10 may refer to the foregoing embodiment. The hair styling appliance employs all technical solution of all foregoing embodiments, and thus at least has all beneficial effects brought by the technical solutions of the foregoing embodiments, which are not be described here in detail. A drive mechanism 211 is arranged in the handle 21, the curling rod 22 is rotatably mounted at one end of the handle 21, a housing 11 of the integrated conducting ring 10 is fastened to the handle 21, and a first end of a rotating member 12 on the integrated conducting ring 10 is connected to the curling rod 22, and a lead wire 16 extending out from the first end is electrically connected to a heating assembly on the curling rod 22, a second end of the rotating member 12 is connected to the drive mechanism 211, and a wiring assembly 13 on the integrated conducting ring 10 is electrically connected to a circuit board 212 in the handle 21. Therefore, during use, the annular electrode 15 and the conducting member 131 can be effectively protected, a risk that dust, welding slag and other foreign matters enter between the annular electrode 15 and the conducting member 131 is reduced, and use reliability of the integrated conducting ring 10 is improved, thereby improving use reliability of the hair styling appliance and improving user experience.

The present disclosure further provides a hair styling appliance. As shown in FIG. 7 to FIG. 11, the hair styling appliance includes a handle 21, a styling accessory 30, and an integrated conducting ring 10. A specific structure of the integrated conducting ring 10 may refer to the foregoing embodiment. The hair styling appliance employs all technical solution of all foregoing embodiments, and thus at least has all beneficial effects brought by the technical solutions of the foregoing embodiments, which are not be described here in detail. A drive mechanism 211 is arranged in the handle 21, the styling accessory 30 is rotatably mounted at one end of the handle 21, a housing 11 is fastened to the handle 21, a first end is connected to the styling accessory 30, a lead wire 16 extending out from the first end is electrically connected to an electrical appliance on the styling accessory 30, a second end is connected to the drive mechanism 211, and a wiring assembly 13 on the integrated conducting ring 10 is electrically connected to a circuit board 212 in the handle 21.

Specifically, one or more keys are disposed on the handle 21 to control the drive mechanism 211 to start or stop as well as control the hair styling appliance to start or stop. The styling accessory 30 may be a curling attachment, an airflow comb attachment, or the like. During actual use, the user can choose to turn on or off the drive mechanism 211 according to the type of styling accessory 30.

The first end of the rotating member 12 is provided with multiple first conducting terminals 217, each lead wire 16 is at least connected to one first conducting terminal 217, the styling accessory 30 is provided with multiple second conducting terminals 36, the multiple second conducting terminals 36 are electrically connected to the electrical appliance. When the styling accessory 30 is mounted to the handle 21, the first end is connected to the styling accessory 30, and the multiple first conducting terminals 217 abut against the multiple second conducting terminals 36 one by one to achieve conducting connection.

In some embodiments, a first air duct 213 and a fan assembly 214 are arranged in the handle 21, the fan assembly 214 is located in the first air duct 213 and electrically connected to the circuit board 212, the styling accessory 20 is provided with a second air duct 301 and multiple air outlets 302, and the multiple air outlets 302 are located on a peripheral surface of the styling accessory 30 and communicate with the second air duct 301. The electrical appliance includes a heating assembly 331, the heating assembly 331 is located in the second air duct 301, and when the styling accessory 30 is mounted on the handle 21, the second air duct 301 communicates with the first air duct 213. A front end of the handle 21 is provided with a vent port 215, and a rear end of the handle 21 is provided with an air inlet 216. During use, after the fan assembly 214 drives airflow to enter the first air duct 231 from the air inlet 216, the airflow flows to the second air duct 301 from the vent port 215. The airflow flowing into the second air duct 301 is heated by the heating assembly 331, and finally blown out from the air outlet 302 as hot air, so that the hair can be dried by the hot air. When the drive mechanism 211 is started, the styling accessory 30 can be driven to rotate, thereby curling hair by means of hot airflow blow out from the styling accessory 30. The heating assembly 331 uses a heating wire, a heating film or a ceramic heating element as a heating source.

In some embodiments, the styling accessory 30 is provided with multiple comb teeth 31, the multiple teeth 31 are distributed in a circumferential direction of the styling accessory 30 and extend out relative to a peripheral surface of the styling accessory 30, and the comb teeth 31 and the air outlets 302 are arranged in a staggered manner. In this way, during use, hair can be combed by the comb teeth 31, so that the hair can be evenly distributed around the styling accessory 30. This helps improve the hair drying speed and curling effect.

In some embodiments, the electrical appliance further includes a phototherapy lamp 332, and the phototherapy lamp 332 is configured to emit light toward a peripheral side of the styling accessory 30. Specifically, the phototherapy lamp 332 can emit light with a specific wavelength (such as blue light, red light, infrared light or ultraviolet light, and the like), thereby carrying out phototherapy on the hair or scalp by using light.

In some embodiments, the styling accessory 30 is provided with a connecting shaft 32, the connecting shaft 32 is connected to the first end and is located in the second air duct 301, the phototherapy lamp 332 is arranged on the connecting shaft 32 and correspond to the air outlet 302, and the phototherapy lamp 332 is configured to emit light toward the outside of the styling accessory 30 through the air outlet 302. In this way, the connecting shaft 32 can be used to mount the phototherapy lamp 332, the air outlet can be used for light transmitting, so that a structure of the styling accessory 30 can be simplified.

In some embodiments, as shown in FIG. 9 to FIG. 13, the first air duct 213 and a fan assembly 214 are arranged in the handle 21, and the fan assembly 214 is located in the first air duct 203 and electrically connected to the circuit board 212. The styling accessory 30 includes a sleeve portion 34, and an air guide portion 35 horizontally arranged at one end of the sleeve portion 34. A third air duct 351 is arranged in the air guide portion 35, one end of the air guide portion 35 is provided with a blowout port 352, and the blowout port 352 communicates with the third air duct 351. The sleeve portion 34 is sleeved on one end of the handle 21, and the third air duct 351 communicates with the first air duct 213. Specifically, the air guide portion 35 is approximately perpendicular to the handle 21, so that the hair styling appliance can be used as a hair drier to facilitate hair care of a user.

In some embodiments, a cylindrical portion 353 is arranged in the air guide portion 35, which extends from one end of the air guide portion 35 to the other end. The third air duct 351 is annularly arranged on the cylindrical portion 353, and the blowout port 352 is annularly arranged at an end face of the air guide portion 35 to correspond to the third air duct 351. The electrical appliance may include a phototherapy lamp 332, the phototherapy lamp 332 is arranged at the cylindrical portion 353, the air guide portion 35 is provided with a light-transmitting portion at an end portion of the blowout port 352, the light-transmitting portion 354 corresponds to the phototherapy lamp 332, and the phototherapy lamp 332 is configured to emit light outward through the light-transmitting portion 354. Therefore, an orientation of the phototherapy lamp 332 is clear, which is convenient for the user to accurately irradiate a site needing phototherapy with the phototherapy lamp 332. The light-transmitting portion 354 may be provided with a through hole, or the light-transmitting portion 354 may be configured as a transparent structure to allow the light to pass through.

In some embodiments, the styling accessory includes a mounting seat, and a heat conducting cylinder arranged on the mounting seat. The electrical appliance includes a heating assembly, the heating assembly is located in the heat conducting cylinder and in heat conduction connection with the heat conducting cylinder. Specifically, the mounting seat can be rotatably mounted at a front end of the handle. When a power supply is turned on, the heating assembly can generate heat and transfer the heat to the heat conducting cylinder, and then the heat conducting cylinder can be used for a curling operation. In addition, the styling accessory can be driven to rotate by the drive mechanism to achieve automatic hair curling which is convenient for the user to use. The heating assembly uses a heating wire, a heating film or a ceramic heating body as a heating source.

The foregoing embodiments are merely preferred embodiments of the present disclosure, and are not intended to limit the patent scope of the present disclosure. Under the inventive concept, any equivalent structure transformation made according to the contents of the specification and accompanying drawings in the present disclosure, whether directly or indirectly applied to other related technical field, are within the patent scope of the present disclosure.

What is claimed is:

1. An integrated conducting ring, comprising:

a housing, provided with a middle through hole and a plurality of mounting holes, wherein the plurality of mounting holes are spaced apart in an axial direction of the middle through hole, and run through an inner wall of the middle through hole;

a rotating member, rotatably mounted in the middle through hole and provided with a plurality of annular electrodes and a plurality of lead wires, wherein the plurality of annular electrodes are spaced apart in the axial direction of the middle through hole and correspond to the multiple mounting holes one by one, the multiple lead wires are correspondingly connected to the multiple annular electrodes one by one and extend out from a first end of the rotating member, the first end of the rotating member is used for connecting to a driven mechanism, a second end of the rotating member is used for connecting to a drive mechanism; and a wiring assembly, comprising a plurality of conducting members, wherein each conducting member is correspondingly mounted in one mounting hole and abuts against the corresponding annular electrode;

wherein the conducting member is a pogo pin;

wherein the wiring assembly further comprises a circuit board, and the plurality of conducting members are fastened to the circuit board.

2. The integrated conducting ring according to claim 1, wherein the plurality of mounting holes are disposed on a same side of the middle through hole.

3. The integrated conducting ring according to claim 2, wherein the housing comprises a first housing and a second housing which are assembled together to form the middle through hole, and the first housing is provided with the plurality of mounting holes.

4. The integrated conducting ring according to claim 1, wherein the wiring assembly further comprises an elastic member and a stopper, the stopper is located outside each of the plurality of mounting holes, and the elastic member is located in each of the plurality of mounting holes and abuts between each of the conducting members and the stopper.

5. The integrated conducting ring according to claim 4, wherein the elastic member is a spring, and the elastic member and the stopper are both conductors.

6. The integrated conducting ring according to claim 5, wherein the conducting member is a conducting sphere; or the conducting member is a carbon brush; or the conducting member is a conducting post.

7. The integrated conducting ring according to claim 1, wherein each of the annular electrodes is provided with a connecting portion extending toward an inner side, the connecting portion is connected to the lead wire, the annular electrode and the lead wire are used as inserts to be in integrated injection molded with the rotating member.

* * * * *